US011108124B2

(12) United States Patent
Zhu et al.

(10) Patent No.: US 11,108,124 B2
(45) Date of Patent: Aug. 31, 2021

(54) FILTER ANTENNA

(71) Applicant: AAC Technologies Pte. Ltd., Singapore (SG)

(72) Inventors: Zhimin Zhu, Shenzhen (CN); Jianchun Mai, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 15 days.

(21) Appl. No.: 16/703,782

(22) Filed: Dec. 4, 2019

(65) Prior Publication Data

US 2020/0212530 A1 Jul. 2, 2020

(30) Foreign Application Priority Data

Dec. 31, 2018 (CN) ..... 201811650559.3

(51) Int. Cl.

| | |
|---|---|
| ***H01Q 1/38*** | (2006.01) |
| ***H01P 1/208*** | (2006.01) |
| ***H01Q 9/04*** | (2006.01) |
| ***H01Q 21/06*** | (2006.01) |

(52) U.S. Cl.

CPC ..... *H01P 1/2088* (2013.01); *H01Q 9/0414* (2013.01); *H01Q 21/065* (2013.01)

(58) Field of Classification Search

CPC .. H01P 1/2088; H01Q 9/0414; H01Q 21/065; H01Q 1/241; H01Q 9/045

See application file for complete search history.

(56) References Cited

U.S. PATENT DOCUMENTS

| | | | | |
|---|---|---|---|---|
| 9,865,928 | B2 * | 1/2018 | Sudo | H01Q 5/378 |
| 2003/0020173 | A1 * | 1/2003 | Huff | H01P 1/184 257/774 |
| 2019/0131711 | A1 * | 5/2019 | Sotoma | H01Q 9/0442 |

* cited by examiner

*Primary Examiner* — Dieu Hien T Duong

(74) *Attorney, Agent, or Firm* — W&G Law Group LLP

(57) ABSTRACT

The present disclosure provides a filter antenna, including a radiation structure, a filter structure and a feed structure, the radiation structure comprises a plurality of antenna units stacked from top to bottom, the filter structure comprises a plurality of resonant cavities stacked from top to bottom and communicating sequentially in a coupling manner, the filter structure includes an input terminal and an output terminal, the radiation structure and the filter structure are stacked from top to bottom and electrically connected through the output terminal, and the feed structure has one end electrically connected to the input terminal of the filter structure and another end connected to an external power supply. Miniaturization is achieved by the stacking structure, filtering performance of the bandwidth is obtained by using the multi-stage SIW cavities cascaded, and the interference from out-of-band spurious signals in a frequency range of the bandwidth is effectively suppressed.

8 Claims, 5 Drawing Sheets

FILTER ANTENNA

TECHNICAL FIELD

The present disclosure relates to the field of microwave communication, and in particular, to a filter antenna device used in the field of communication electronic products.

BACKGROUND

As 5G becomes the focus of research and development in the global industry, developing 5G technologies and formulating 5G standards have become an industry consensus. The characteristics of high carrier frequency and large bandwidth unique to the millimeter wave are the main solutions to achieve a 5G ultra-high data transmission rate. The rich bandwidth resources of the millimeter wave band provide a guarantee for a high-speed transmission rate. However, due to the severe spatial loss of electromagnetic waves in this frequency band, wireless communication systems using the millimeter wave band need to adopt a phased array architecture. The phases of respective array elements are distributed according to certain regularity by a phase shifter, so that a high gain beam is formed and the beam scans over a certain spatial range through a change in phase shift. It is inevitable for an antenna and a filter, as indispensable components in a radio frequency (RF) front-end system, to develop towards a direction of integration and miniaturization while taking into account an antenna performance, so how to achieve a miniaturized structural design while ensuring the antenna performance is a difficult problem in current research and development of antenna technology.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

Figure 1:
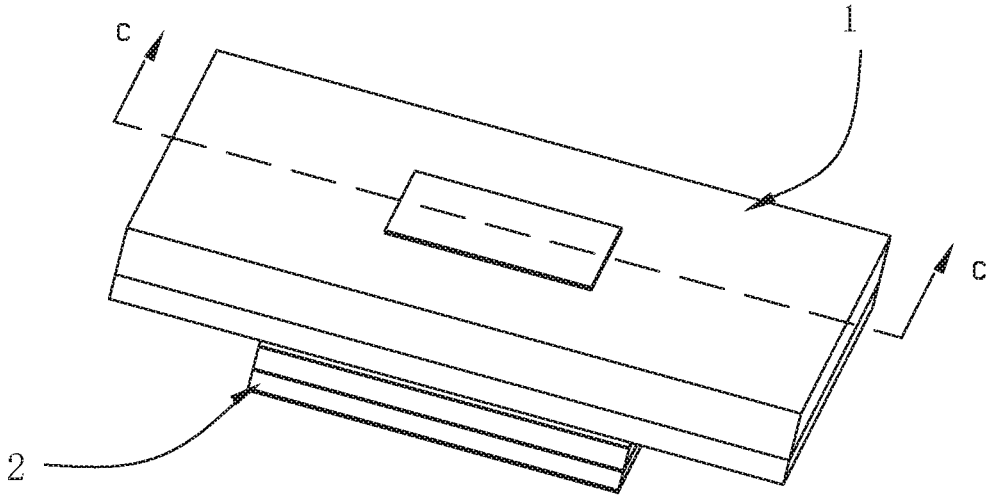
FIG. 1 is a perspective structural schematic diagram of an overall structure of a filter antenna device provided by the present disclosure.

In the drawing, 1—radiation structure, 2—filter structure, 3—feed structure, 11—first antenna unit, 12—second antenna unit, 21—first resonant cavity, 22—second resonant cavity, 23—third resonant cavity, 24—fourth resonant cavity, 31—microstrip feeder line, 41—first patch layer, 42—second patch layer, 44—first metal layer, 45—second metal layer, 46—third metal layer, 47—fourth metal layer, 48—fifth metal layer, 51—first dielectric substrate, 52—second dielectric substrate, 53—third dielectric substrate, 54—fourth dielectric substrate, 55—fifth dielectric substrate, 56—sixth dielectric substrate, 57—seventh dielectric substrate, 61—first through hole, 62—second through hole, 63—third through hole, 64—fourth through hole, 65—fifth through hole, 66—sixth through hole, 71—first metal probe, 72—second metal probe, 81—first coupling gap, 82—second coupling gap, 83—third coupling gap, 91—first metallized through hole, 92—second metallized through hole, 93—third metallized through hole, 94—fourth metallized through hole, A—input terminal, B—output terminal.

DESCRIPTION OF EMBODIMENTS

The present disclosure will be further illustrated with reference to the accompanying drawings and the embodiments.

Figure 2:
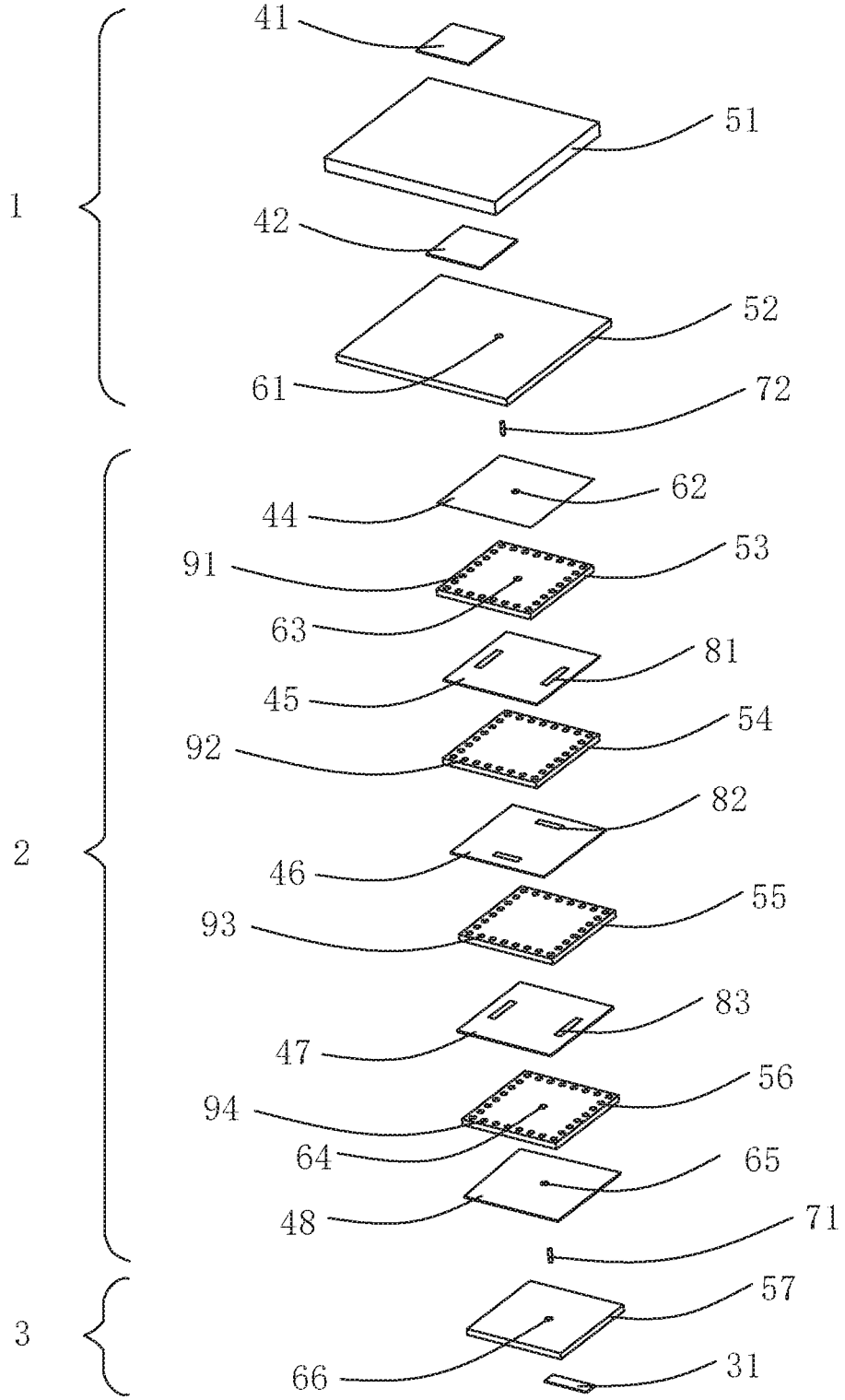
FIG. 2 is an exploded structural schematic diagram of a partial structure of a filter antenna device provided by the present disclosure.
Figure 3:
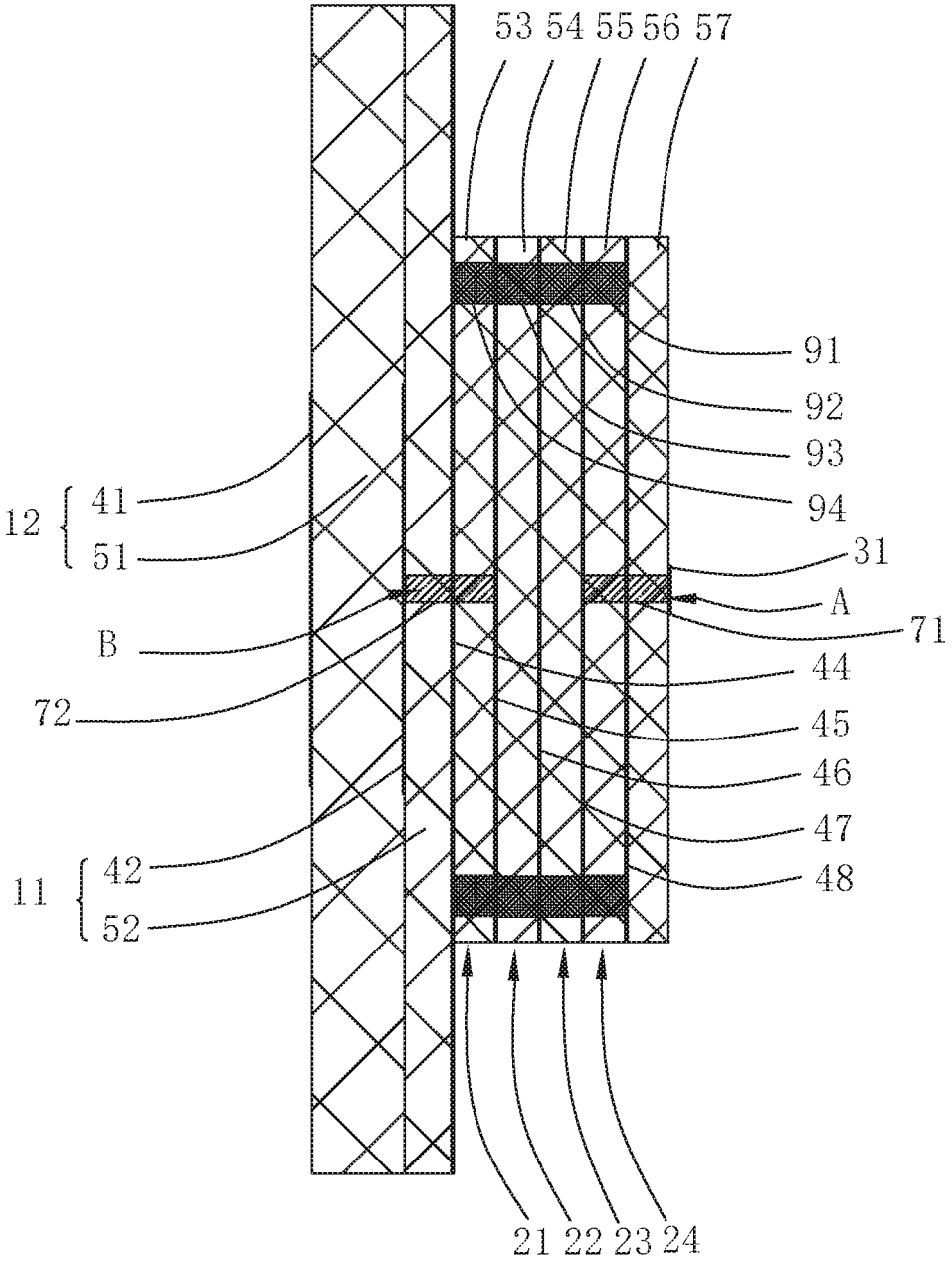
FIG. 3 is a cross-sectional diagram of a filter antenna device shown in FIG. 1 taken along line C-C.

As shown in FIG. 1 to FIG. 3, an embodiment provides a filter antenna, including a radiation structure 1, a filter structure 2, and a feed structure 3. The radiation structure 1 includes a plurality of antenna units stacked from top to bottom, e.g., a first antenna unit 11 and a second antenna unit 12. The first antenna unit 11 and the second antenna unit 12 are spaced from and coupled to each other, to irradiate an electromagnetic wave signal outwardly. The filter structure 2 includes a plurality of resonant cavities sequentially stacked from top to bottom and sequentially connected with one another in a coupling manner, e.g., a first resonant cavity 21, a second resonant cavity 22, a third resonant cavity 23, and a fourth resonant cavity 24. The four resonant cavities are sequentially connected with one another in a coupling manner. The filter structure further includes an input terminal A and an output terminal B. The radiation structure 1 and the filter structure 2 are stacked from top to bottom and electrically connected to each other through the output terminal B. The feed structure 3 has one end electrically connected to the input terminal A of the filter structure 2, and another end used for externally connecting a power source.

It should be noted that "stacked from top to bottom" in the text refers to a positional relationship in FIG. 1 of the present disclosure. If a placement state of the filter antenna changes, then the plurality of antenna units, the plurality of resonant cavities, and the radiation structure and the filter structure are no longer stacked from top to bottom.

The first antenna unit 11 and the second antenna unit 12 are both microstrip patch antennas. The first antenna unit 11 is close to the filter structure 2, and the second antenna unit 12 is provided on a side of the first antenna unit 11 facing away from the filter structure and is spaced apart from the first antenna unit 11. Specifically, a first patch layer 41, a first dielectric substrate 51, a second patch layer 42, and a second dielectric substrate 52 are arranged sequentially from top to bottom. The first patch layer 41 and the first dielectric substrate 51 together constitute the second antenna unit 12; and the second patch layer 42 and the second dielectric substrate 52 together constitute the first antenna unit 11.

A specific structure of the microstrip patch antenna can be selected according to practical use, for example, adopting a rectangular shape, a circular shape, a ring shape, a triangular shape, a fan shape, a serpentine shape, etc. In an embodiment, a square microstrip patch antenna is used. That is, the first patch layer 41 and the second patch layer 42 have a square shape.

The filter structure 2 is an SIW cavity filter. Specifically, a first metal layer 44, a third dielectric substrate 53, a second metal layer 45, a fourth dielectric substrate 54, a third metal layer 46, a fifth dielectric substrate 55, a fourth metal layer 47, a sixth dielectric substrate 56, and a fifth metal layer 48 are sequentially arranged from top to bottom. A plurality of first metallized through holes 91 is disposed at intervals on a periphery of the third dielectric substrate 53 and electrically connects the first metal layer 44 with the second metal layer 45. The first metal layer 44, the third dielectric substrate 53, and the second metal layer 45 and the first metallized through holes 91 together enclose the first resonant cavity 21. A plurality of second metallized through holes 92 is disposed at intervals on a periphery of the fourth dielectric substrate 54 and electrically connects the second metal layer 45 with the third metal layer 46. The second metal layer 45, the fourth dielectric substrate 54, the third metal layer 46 and the second metallized through holes 92 together enclose the second resonant cavity 22. A plurality of third metallized through holes 93 is disposed at intervals on a periphery of the fifth dielectric substrate 55 and electrically connects the third metal layer 46 with the fourth metal layer 47. The third metal layer 46, the fifth dielectric substrate 55, the fourth metal layer 47 and the third metallized through holes 93 together enclose the third resonant cavity 23. A plurality of fourth metallized through holes 94 is provided at intervals on a periphery of the sixth dielectric substrate 56 and electrically connects the fourth metal layer 47 with the fifth metal layer 48. The fourth metal layer 47, the sixth dielectric substrate 56, the fifth metal layer 48 and the fourth metallized through holes 94 together enclose the fourth resonant cavity 24. The second metal layer 45, the third metal layer 46, and the fourth metal layer 47 are provided with a first coupling gap 81, a second coupling gap 82, and a third coupling gap 83, respectively. The first resonant cavity 21 and the second resonant cavity 22 are in coupling communication through the first coupling gap 81. The second resonant cavity 22 and the third resonant cavity 23 are in coupling communication through the second coupling gap 82. The third resonant cavity 23 and the fourth resonant cavity 24 are in coupling communication through the third coupling gap 83. The shapes of the coupling gaps can be specifically selected according to practical application requirements, and a shape of a rectangle, a circle, a trapezoid, etc. can be used. The shapes of the first coupling gap 81, the second coupling gap 82, and the third coupling gap 83 may be the same or different, and may be specifically selected according to practical application requirements. In an embodiment, the three coupling gaps have the same shape of rectangle.

The specific arrangement positions of the three coupling gaps having the same shape may use an overlapping arrangement manner or a non-overlapping arrangement manner, and the overlapping arrangement manner means that projections of the three coupling gaps completely coincide. In an embodiment, the first coupling gaps 81 and the third coupling gaps 83 are arranged in an overlapping manner and located on two sides of the second metal layer 45 and two sides of the fourth metal layer 47, respectively; the second coupling gaps 82 are arranged in a non-overlapping manner with but perpendicular to the first coupling gaps 81 and the third coupling gaps 83 and located on two sides of the third metal layer 46.

In an embodiment, the input terminal A of the filter structure 2 includes a first metal probe 71, and the output terminal B includes a second metal probe 72. The second metal probe 72 allows electrical connection between the second metal layer 45 and the second patch layer 42 and allows electrical connection between the radiation structure 1 and the filter structure 2. The first metal probe 71 allows electrical connection between the fourth metal layer 47 and the feed structure 3.

In an embodiment, the second dielectric substrate 52 is provided with a first through hole 61, the first metal layer 44 is provided with a second through hole 62, and the third dielectric substrate 53 is provided with a third through hole 63, for use in conjunction with the second metal probe 72. That is, the second metal probe 72 extends through the first through hole 61, the second through hole 62 and the third through hole 63 so as to connect the second metal layer 45 with the second patch layer 42. The sixth dielectric substrate 56 is provided with a fourth through hole 64, and the fifth metal layer 48 is provided with a fifth through hole 65, for use in conjunction with the first metal probe 71. That is, the first metal probe 71 extends through the fourth through hole 64 and the fifth through hole 65 so as to connect the fourth metal layer 47 with the feed structure 3.

In an embodiment, the feed structure 3 includes a microstrip feeder line 31 and a seventh dielectric substrate 57. The seventh dielectric substrate 57 is provided with a sixth through hole 66. The microstrip feed line 31 is located on a bottom face of the seventh dielectric substrate 57 facing away from the filter structure 3, and the first metal probe 71 passes through the sixth through hole 66 to be electrically connected with the microstrip feeder line 31. In practical use, different feed structures, such as coplanar waveguides, coaxial feeder lines, etc., may be selected according to the use, which is not limited to the microstrip feeder lines.

In an embodiment, all the dielectric substrates in the filter structure use an LTCC material.

Figure 4:
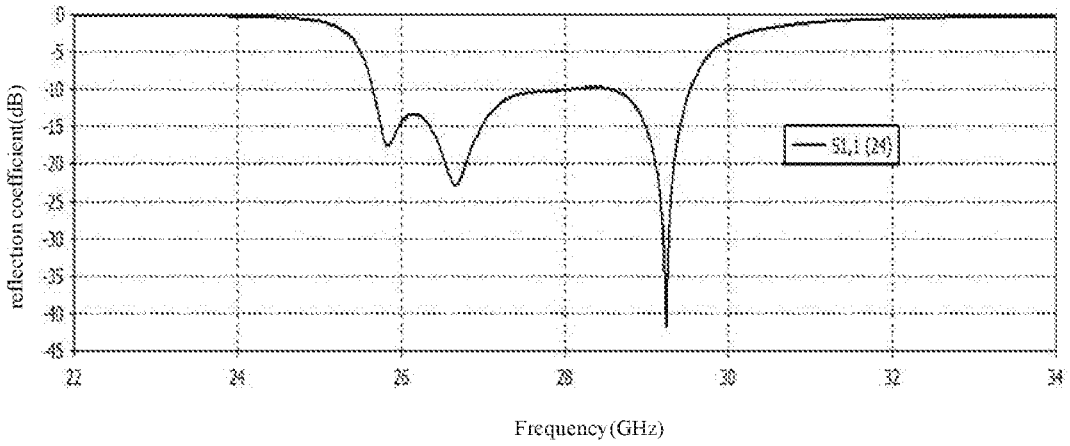
FIG. 4 illustrates a reflection coefficient graph of a filter antenna device provided by the present disclosure.
Figure 5:
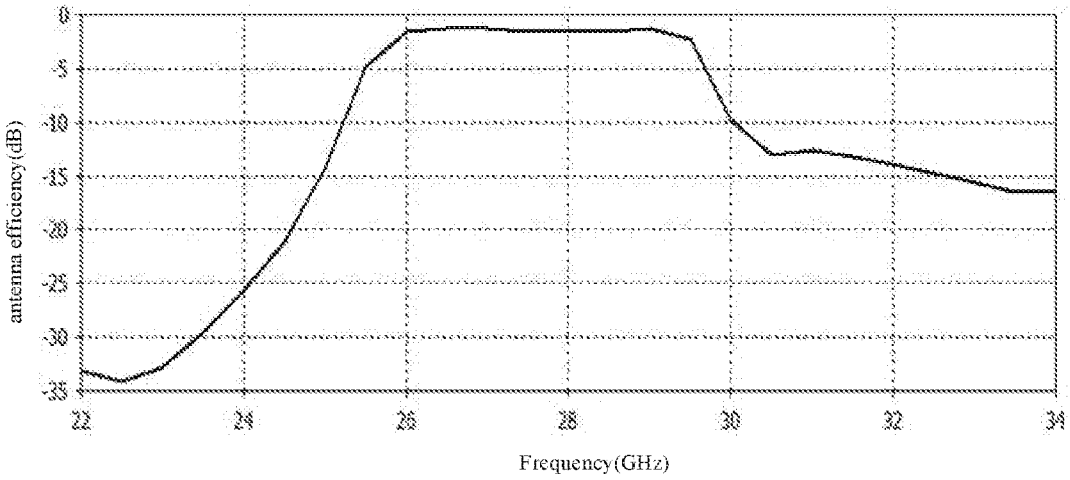
FIG. 5 illustrates an overall efficiency graph of a filter antenna device provided by the present disclosure.
Figure 6:
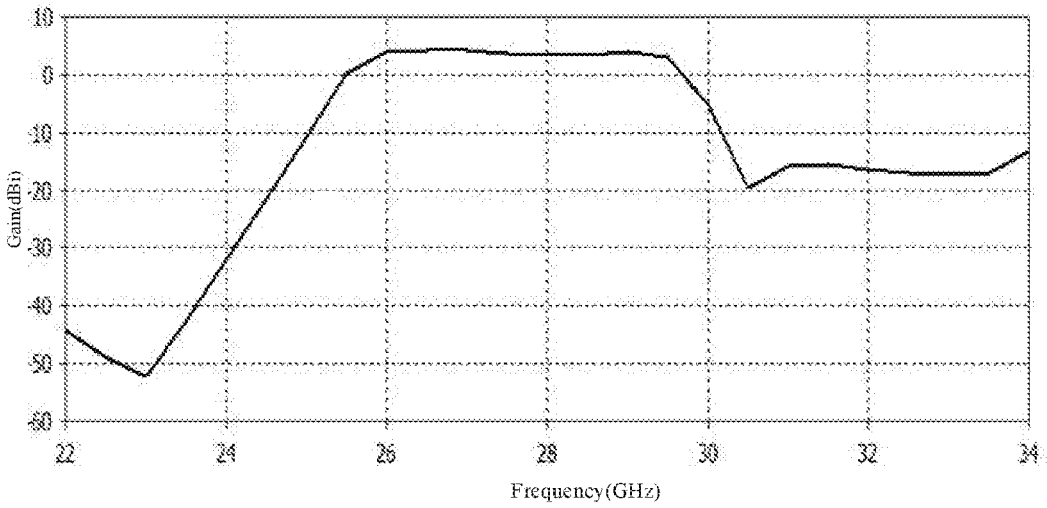
FIG. 6 illustrates a gain graph of a filter antenna device provided by the present disclosure.

In FIG. 4, FIG. 5 and FIG. 6, performance simulation graphs of the filter antenna provided in the present disclosure are illustrated. FIG. 4 illustrates a reflection performance simulation graph of the filter antenna. FIG. 5 illustrates an efficiency performance simulation graph of the filter antenna. FIG. 6 illustrates a gain performance simulation graph of the filter antenna. It can be seen that, in a range of a band of 25.66-29.6 GHz, the filter antenna proposed by the present disclosure has an antenna return loss smaller than 10 dB (a reflection coefficient is smaller than −10 dB), an out-of-band rejection not smaller than 20 dB, and an maximum in-band gain fluctuation smaller than 0.6 dB, such that interference from out-of-band spurious signals is effectively suppressed, and the antenna performance is effectively improved. In summary, the filter antenna proposed by the present disclosure allows a miniaturization design of the antenna while improving the performance of the antenna.

The above are merely embodiments of the present disclosure, and it should be noted herein that those skilled in the art can make variations and improvements without departing from the inventive concept of the present disclosure, but these are all within the protection scope of the present disclosure.

What is claimed is:

1. A filter antenna, comprising:

a radiation structure comprising a plurality of antenna units stacked from top to bottom;

a filter structure comprising a plurality of resonant cavities stacked from top to bottom, each of the plurality of resonant cavities of the filter structure comprises metal layers spaced apart from one another and metalized through holes that are provided in peripheries of the metal layers and electrically connect the metal layers; a number of the plurality of resonant cavities is at least two, the plurality of resonant cavities sequentially communicating with one another in a coupling manner; and a feed structure, wherein the filter structure comprises an input terminal and an output terminal, the radiation structure and the filter structure are stacked from top to bottom and electrically connected to each other through the output terminal, and the feed structure has one end electrically connected to the input terminal of the filter structure and another end connected with an external power supply.

2. The filter antenna as described in claim 1, wherein the radiation structure comprises a first antenna unit close to the filter structure and a second antenna unit provided on a side of the first antenna unit facing away from the filter structure and spaced apart from the first antenna unit, the first antenna unit is electrically connected to the filter structure through the output terminal, and the second antenna unit is coupled to the first antenna unit.

3. The filter antenna as described in claim 2, wherein the first antenna unit and the second antenna unit are both microstrip patch antennas.

4. The filter antenna as described in claim 1, wherein each of the metal layers of each of the plurality of resonant cavities is provided with coupling gaps so as to be in coupling communication with the resonant cavity adjacent thereto.

5. The filter antenna as described in claim 4, wherein the coupling gaps of two adjacent metal layers are staggered.

6. The filter antenna as described in claim 1, wherein a number of the plurality of resonant cavities is four.

7. The filter antenna as described in claim 1, wherein the input terminal of the filter structure comprises a first metal probe, the output terminal of the filter structure comprises a second metal probe, the first metal probe electrically connects the feed structure with one of the metal layers, facing away from the feed structure, of one of the plurality of resonant cavities adjacent to the feed structure, and the second metal probe electrically connects the radiation structure with one of the metal layers, facing away from the radiation structure, of one of the plurality of resonant cavities adjacent to the radiation structure.

8. The filter antenna as described in claim 1, wherein the feed structure is a microstrip feeder line.

* * * * *